US006904331B2

(12) United States Patent
Sasaki et al.

(10) Patent No.: US 6,904,331 B2
(45) Date of Patent: Jun. 7, 2005

(54) METHOD OF PAPER MACHINE CONTROL AND APPARATUS FOR THE METHOD

(75) Inventors: Takashi Sasaki, Tokyo (JP); Kenichiro Yahiro, Tokyo (JP); Takao Maruyama, Tokyo (JP); Yoshitatsu Mori, Tokyo (JP); Takahiro Ishizaki, Tokyo (JP); Kenji Takao, Tokyo (JP); Hirofumi Shimizu, Tokyo (JP)

(73) Assignee: Yokogawa Electric Corporation, Tokyo (JP)

( * ) Notice: Subject to any disclaimer, the term of this patent is extended or adjusted under 35 U.S.C. 154(b) by 429 days.

(21) Appl. No.: 10/058,451

(22) Filed: Jan. 28, 2002

(65) Prior Publication Data

US 2002/0198621 A1 Dec. 26, 2002

(30) Foreign Application Priority Data

Apr. 4, 2001 (JP) ..... 2001-106038

(51) Int. Cl.[7] ..... G06F 7/66; F26B 3/00
(52) U.S. Cl. ..... 700/128; 34/446; 162/253
(58) Field of Search ..... 700/128; 162/198; 34/446

(56) References Cited

U.S. PATENT DOCUMENTS 3,801,426 A * 4/1974 Putman et al. ..... 162/198
3,886,036 A * 5/1975 Dahlin ..... 162/198
6,365,004 B1 * 4/2002 Hamstrom et al. ..... 162/198
6,473,670 B1 * 10/2002 Huhtelin ..... 700/128

* cited by examiner

*Primary Examiner*—Leo Picard
*Assistant Examiner*—Sheela Rao
(74) *Attorney, Agent, or Firm*—Moonray Kojima

(57) ABSTRACT

The present invention is characterized in that in a simulation for predicting a steam pressure setpoint after grade change, an initial moisture percentage is evaluated from differences between bone-dry basis weights and between machine speeds before and after grade change; the bone-dry coated weight of a size is evaluated from the flow rate and concentration thereof; and then the dryer inlet moisture percentage of a web after a size press is calculated from the coated weight. Thus, the invention intends to improve the quality of products through precise dryer control, as well as reduce the time required for grade change, by precisely predicting the web's initial moisture percentage at the dryer inlet after grade change and precisely and quickly controlling dryer steam pressure during grade change.

18 Claims, 9 Drawing Sheets

FIG.2 (PRIOR ART)

| | <2-1> Temperature (°C) | <2-2> Thickness (m) | <2-3> Heat-transfer Coefficient (kJ/( m$^3$ ·sec·°C)) | <2-4> Specific Heat (kJ/(kg·°C)) | <2-5> Density (kg/m$^3$) |
|---|---|---|---|---|---|
| <2-6> Air | $T_a$ | | | | |
| <2-7> Canvas | $T_3$ | $L_C$ | $h_a$ | $C_C$ | $\rho_C$ |
| <2-8> Web | $T_2$ | $L_W$ | $h_{WC}$ | $C_W$ | $\rho_W$ |
| <2-9> Steam drum | $T_1$ | $L_D$ | $h_{DW}$ | $C_D$ | $\rho_D$ |
| <2-10> Steam | $T_S$ | | $h_S$ | | |

METHOD OF PAPER MACHINE CONTROL AND APPARATUS FOR THE METHOD

BACKGROUND OF THE INVENTION

1. Field of Invention

The present invention relates to a method and a system for controlling a paper machine, wherein a dryer is controlled by predicting the moisture percentage of a web at a dryer part inlet and also predicting the dryer's steam pressure according to the predicted moisture percentage.

2. Description of Prior Art

FIG. 1 is a schematic view showing the configuration of a typical paper machine. In the figure, raw pulp is discharged from a stock inlet 81 to a wire part 82. The wire part 82 is moved in the direction of arrow A by means of rotating rolls 821. The raw pulp discharged onto the wire part 82 is subjected to drainage so as to form a web (that is paper). The web thus formed is transferred to a press part 83 for further water drainage.

The web subjected to water drainage at the press part 83 is transferred to a pre-dryer 84. A multitude of steam drums 841 are disposed in the pre-dryer 84 and heated by steam introduced thereinto. The web is wound around the steam drums as it is moved forward, so that the web is drived until a given moisture percentage is reached.

The dried web is subjected to a sizing process, such as application of a sizing agent (coating agent) at a size press 85; is further dried by an after-dryer 86; and is then take up as a product indicated by numeral 87. It should be noted that the after-dryer 86 is configured in the same way as the pre-dryer 84.

Numerals 88 and 89 denote BM systems, both of which detect the basis weight, moisture percentage, and other data items of the web as it comes out of the pre-dryer 84 and after-dryer 86, respectively. The values of data items thus detected are input to a control apparatus not shown in the figure. The control apparatus controls the amount of raw pulp discharged onto the wire part 82 or the amount of steam introduced into the steam drums of the pre-dryer 84 and after-dryer 86, as well as the machine speed and other parameters, so that the product in question complies with predetermined specifications. Grade change control whereby different types of product are produced is also practiced commonly.

In grade change control, any product obtained during the time of grade change, wherein a switch is made to another type of product, will be treated as broke, i.e., non-standard paper. Therefore, the duration of grade change must be minimized in order to increase operation efficiency. To solve this problem, an invention of a method of predicting a steam pressure setpoint after grade change by simulation is described in the specification of U.S. Pat. No. 3,094,798.

Now, the aforementioned invention is described briefly.

The invention described in the specification of U.S. Pat. No. 3,094,798 uses an iron model wherein the steam drums of the pre-dryer 84 and after-dryer 86 are simplified into a planar form. In the model, the state of contact among the steam drum, web, and canvas wound continuously round the steam drums is classified into five patterns. Then, the heat-transfer differential equation of each pattern is derived and converted to a difference equation, so that a steam pressure setpoint after grade change is predicted by solving the difference equation.

For convenience, the numbering of the equations in this specification are 5–13 and 18–23. The numbers 1–4 and 14–17 have been omitted.

The heat-transfer differential equations of a pattern wherein the steam drum, web and canvas are in contact with each other in this order are represented as equations 5 to 7 below.

$$L_D \cdot \rho_D \cdot C_D \frac{dT_1(t)}{dt} = h_S \cdot (T_S(t) - T_1(t)) - h_{DW} \cdot (T_1(t) - T_2(t)) \quad (5)$$

$$L_W \cdot \rho_W \cdot C_W \frac{dT_2(t)}{dt} = h_{DW} \cdot (T_1(t) - T_2(t)) - h_{WC} \cdot (T_2(t) - T_3(t)) Evapo(T_2, T_W) \quad (6)$$

$$L_C \cdot \rho_C \cdot C_C \frac{dT_3(t)}{dt} = h_{WC} \cdot (T_2(t) - T_3(t)) - h_a \cdot (T_3(t) - T_a(t)) \quad (7)$$

The meanings of the parameters included in equations 5 to 7 are as follows.

| | |
|---|---|
| $L_D$: | Drum thickness (m) |
| $L_W$: | Web thickness (m) |
| $L_C$: | Canvas thickness (m) |
| $T_s$: | Steam temperature within drum (° C.) |
| $T_1$: | Drum's surface temperature (° C.) |
| $T_2$: | Web (paper) temperature (° C.) |
| $T_3$: | Canvas temperature (° C.) |
| $T_a$: | Dry-bulb temperature of air within hood (° C.) |
| $C_D$: | Drum's specific heat (kJ/(kg · ° C.)) |
| $C_W$: | Web's (paper's) specific heat (kJ/(kg · ° C.)) |
| $C_C$: | Canvas' specific heat (kJ/(kg · ° C.)) |
| $\rho_D$: | Drum's density (kg/m$^3$) |
| $\rho_W$: | Web's (paper's) density (kg/m$^3$) |
| ρC: | Canvas' density (kg/m$^3$) |
| $h_S$: | Coefficient of heat transfer between steam within drum and drum surface (kJ/(m$^2$ · sec · ° C.)) |
| $h_{DW}$: | Coefficient of heat transfer between drum surface and web (kJ/(m$^2$ · sec · ° C.)) |
| $h_{WC}$: | Coefficient of heat transfer between web surface and canvas (kJ/(m$^2$ · sec · ° C.)) |
| $h_a$: | Coefficient of heat transfer between canvas and air within hood (kJ/(m · sec · ° C.)) |

FIG. 2 is a table that summarizes the above-listed parameters.

The term Evapo($T_2$, $T_W$) in equation 6 is a function representing the amount of heat of evaporation removed from the web as the result of moisture evaporation, and is given by equation 8 below.

$$Evapo(T_2, T_w) = V(MP_{ABS}) \cdot K \cdot (P(T_2) - P(T_w)) \cdot SB(T_2)(kJ/(m^2 \cdot sec)) \quad (8)$$

where

P(T)=Saturation vapor pressure (kPa) at temperature T (° C.)

SB(T)=Heat of evaporation (kJ/$H_2O$kg) at temperature T (° C.)

$T_W$=Wet-bulb temperature of air within hood (° C.)

$V(MP_{ABS})$=Function representing moisture evaporation intensity at absolute moisture percentage $MP_{ABS}$, where $0.0 \leqq V(MP_{ABS}) \leqq 1.0$ (dimensionless)

K=Drying rate coefficient ($H_2O$kg/(m$^2$·sec·kPa)).

Although heat-transfer differential equations for patterns of contact other than those mentioned above are also given by the invention described in the specification of U.S. Pat. No. 3,094,798, these equations are omitted here to avoid complication.

In differential equations 5 to 7 discussed earlier, a length of time is segmented into time intervals Δt, which is determined by the machine speed, circumference of a steam drum, and other data items, so that a difference equation is derived and the numeric solution thereof is obtained. Since the web moves from the upstream side to the downstream side of the paper machine as time elapses, it is possible to calculate the web temperature at the steam drum by numerically solving the difference equation.

From equation 8, EvapoMP($T_2$, $T_W$)($H_2O$kg/($m^2$·sec)), which is the amount of moisture evaporated from the web per unit area and unit time, can be represented by equation 9 below.

$$EvapoMP(T_2, T_W)=V(MP_{ABS})\cdot K\cdot(P(T_2)-P(T_w))(\mathrm{H_2Okg}/(m^2\cdot\mathrm{sec})) \quad (9)$$

By using this equation, it is possible to calculate the absolute moisture percentage $MP_{ABS}(j)$ (j=1, . . . , N) of the web after the lapse of the incremental time interval Δt as shown in equation 10 below.

$$MP_{\mathrm{ABS}}(j+1) = MP_{\mathrm{ABS}}(j) - \frac{10^3\cdot EvapoMP(T_2, T_W)\cdot \Delta t}{BD} \quad (10)$$

where

BD=Bone-dry basis weight(g/$m^2$)

Δt=Incremental time interval (sec)

$MP_{ABS}(j)$ (j=1, . . . , N)=Absolute moisture percentage (%) at mesh division j From this absolute moisture percentage, it is possible to calculate the (relative) moisture percentage MP(j) (j=1, . . . , N) ( %) as shown in equation 11 below.

$$MP(j) = 100\cdot\frac{MP_{\mathrm{ABS}}(j)}{1+MP_{\mathrm{ABS}}(j)}\ (\%) \quad (11)$$

where

MP(j) (j=1, . . . , N)=Relative moisture percentage (%) at mesh division j

FIG. 3 is a flowchart representing the algorithm of a steady-state simulation using equations 5 to 11. In the first step, the current operation status data, such as the current machine speed (m/min), basis weight setpoint (g/$m^2$), and moisture percentage setpoint (%), are acquired. In the second step, the incremental time interval Δt for differential calculations is determined from the machine speed, drum's circumference, and other data items. In the third step, the steam temperature $T_s(j)$ (j=1, . . . , N) within the drum is calculated from the current dryer steam pressure setpoint by using a saturation vapor pressure curve. Note that N is the number of mesh divisions.

In a further step, equations 5 to 11 and the difference equations derived therefrom are used to calculate the drum temperature $T_1(j)$ (j=1, . . . , N), web temperature $T_2(j)$ (j=1, . . . , N), canvas temperature $T_3(j)$ (j=1, . . . , N), and web's final moisture percentage MP(j) (j=1, . . . , N). In yet a further step, a judgment is made on convergence between the web's relative moisture percentage MP(N) and actual measured value $MP_{MEASURE}$ provided by a moisture sensor at a final cylinder. Convergence has been reached if the absolute value of the difference between MP(N) and $MP_{MEASURE}$ is smaller than the given value EP.

If convergence has not yet been reached, the drying rate coefficient K is corrected by ΔK to calculate the drum temperature, web temperature, canvas temperature, and web's relative moisture percentage once again. When convergence has been reached, the drying rate coefficient K, drum temperature $T_1(j)$, web temperature $T_2(j)$, canvas temperature $T_3(j)$, and web's moisture percentage MP(j) are fixed to their values at that moment, and the steady-state simulation ends.

For a dryer part consisting of pre-dryer and after-dryer parts, it is also acceptable to calculate the moisture percentage at an after-dryer outlet as the final moisture percentage. Alternatively, moisture percentages at the pre-dryer and after-dryer outlets may be defined as the final moisture percentages. In the latter case, a convergence calculation should be made for each of the dryer parts.

In the steady-state simulation heretofore discussed, the drying rate coefficient K is adjusted so that the absolute moisture percentage at the final cylinder is approximated to the actual measured value. Next, a simulation of steam pressure prediction is carried out, in order to predict the optimum steam pressure setpoint in an operation status after grade change. The simulation of steam pressure prediction is explained by referring to FIG. 4.

In the first step in FIG. 4, operation status data after grade change, i.e., the machine speed (m/min), basis weight setpoint (g/$m^2$), and moisture percentage setpoint (%), are acquired. In the second step, the incremental time interval Δt for differential calculations is determined from the machine speed, drum's circumference, and other data items. In the third step, the steam temperature $T_s(j)$ (j=1, . . . , N) within the drum is calculated from the current dryer steam pressure setpoint P (kPa) by using a saturation vapor pressure curve. Note that N is the number of mesh divisions.

In a further step, the value of the drying rate coefficient K determined in the steady-state simulation, as well as the value before grade change used in the steady-state simulation, for example, as the pre-dryer part inlet moisture percentage, is used to find the numerical solutions of equations 5 to 11 and their difference equations, thereby calculating the drum temperature $T_1(j)$ (j=1, . . . , N), web temperature $T_2(j)$ (j=1, . . . , N), canvas temperature $T_3(j)$ (j=1, . . . , N), and web's moisture percentage MP(j) (j=1, . . . , N) as the initial values for the difference equations.

In yet a further step, the value of the web's moisture percentage MP(N) at the final cylinder and the moisture percentage setpoint after grade change are compared, in order to judge convergence in the same way as in the case of the steady-state simulation. If convergence has not yet been reached, the dryer steam pressure setpoint is corrected by the given value Δt, and the drum temperature, web temperature, canvas temperature, and web's relative moisture percentage are calculated once again. When convergence has been reached, the values of these data items at that moment are fixed and the simulation of steam pressure prediction ends.

In such a paper machine as discussed above, controlling the process of drying a product is an important factor in order to produce products of consistent quality. Drying at the after-dryer 86 is particularly important since the drying process directly affects product quality. For this reason, it is necessary to precisely know the moisture percentage of a product at the dryer inlet.

Traditionally, the moisture percentage of a product at the inlet of the after-dryer 86 has been calculated by using a measured value provided by the BM system 88 installed before the size press 85 and then applying, for example, equation 12 shown below. It should be noted that the absolute moisture percentage in the equation means the ratio of moisture weight to the bone-dry weight of a web which is a product.

$$absMP_{AFTIN} = \frac{BD_{PRE}\times absMP_{PREEND} + CW\cdot\frac{100-S}{S}}{BD_{AFT}} \quad (12)$$

where $absMP_{AFTIN}$=Absolute moisture percentage (0.0 to 1.0) at after-dryer 86 inlet $absMP_{PREEND}$=Absolute moisture percentage (0.0 to 1.0) at pre-dryer 84 outlet (calculated by simulation)

$BD_{PRE}$=Bone-dry basis weight (g/m$^2$) at pre-dryer 84 outlet (measured with BM system)

$BD_{AFT}$=Bone-dry basis weight (g/m$^2$) at after-dryer 86 outlet (measured with BM system)

CW=Size's bone-dry coated weight (g/m$^2$)

S=Moving average of size's (coating agent's) concentration (%).

The pre-dryer 84 outlet absolute moisture percentage $absMP_{PREEND}$ is evaluated as a solution given by simulating the steady state formed in the pre-dryer 84. However, a size with a concentration of 5 to 10% is coated at the size press 85 and therefore, the moisture percentage must be corrected by the amount of moisture produced by such coating.

More specifically, the first term $BD_{PRE} \times absMP_{PREEND}$ of the numerator on the right-hand side of equation 12 denotes a moisture weight (g/m$^2$) per unit area at the outlet of the pre-dryer 84, whereas the second term CW·(100−S)/S denotes a moisture weight (g/m$^2$) contained in the coated size per unit area. Since the sum of these two terms is the amount of moisture contained per unit area of a product at the inlet of the after-dryer 86, it is clear that the absolute moisture percentage is evaluated by dividing this amount by the bone-dry basis weight $BD_{AFT}$ measured with the BM system 89.

It should be noted that as the size's bone-dry coated weight CW, equation 12 uses the value calculated by equation 13 below, which is the difference between the bone-dry basis weights measured with the BM systems 88 and 89.

$$CW = BD_{AFT} - BD_{PRE} \tag{13}$$

SUMMARY OF THE INVENTION

The following problems have been inherent, however, with the method of calculating the moisture percentage of a web at a dryer inlet in such a paper machine as discussed above and with the simulation of steam pressure prediction after grade change.

In the simulation of steam pressure prediction shown in FIG. 4, the prior art method uses, for example, the same moisture percentage as that before grade change, i.e., a value input from a moisture sensor or such a fixed value as 50%, for the initial moisture percentage MP(1). If operation status data, such as the basis weight or machine speed, changes before or after grade change, then there will also be a change in the wire retention which is the ratio at which raw material remains on a wire part, in the concentration of circulating white water, or in the capability of water drainage at a wire part. Accordingly, it is known that the moisture percentage (normally 40 to 60%) at the dryer inlet also changes consequently.

Furthermore, it is empirically known that the moisture percentage at the dryer inlet increases if the basis weight increases while the machine speed is kept constant. For example, if the basis weight changes by 10 g/m$^2$, the moisture percentage changes by 1 to 2%. If a 1% change takes place in the moisture percentage at the dryer inlet, there will be an approximately 10 kPa change in the predicted value in the simulation of steam pressure prediction shown in FIG. 9. For this reason, the prior art method has the problem that if the moisture percentage at the dryer inlet is set to the same value as that before grade change, the predicted value of steam pressure contains a non-negligible error, against a desirable steam pressure setpoint after grade change.

As is clear from equation 12, the bone-dry basis weight $BD_{PRE}$ at the pre-dryer 84 outlet is used to calculate the moisture percentage. Consequently, the prior art method has another problem that in the case of a paper machine not provided with the BM system 88 that should otherwise be located before the size press 85, it is not possible to calculate the moisture percentage using the equation.

Yet another problem with the prior art method is that even if the BM system 88 is installed at all, the error in moisture percentage calculation due to the measurement accuracy of the BM system tends to become large if the moisture percentage is calculated using equations 12 and 13. In other words, the method of calculation using equations 12 and 13 is problematic since it involves significant calculation errors. This problem is explained here by citing specific examples.

Now, we assume that individual measured values and the moisture percentage calculated therefrom are as follows.

$BD_{PRE}$=100.0 (g/m$^2$)

$BD_{AFT}$=102.0 (g/m$^2$)

CW=2.0 (g/m$^2$)

S=8%

$absMP_{PREEND}$=0.02

By substituting these values into equation 12, we obtain $BD_{PRE} \times absMP_{PREEND} = 100 \times 0.02 = 2.0$ $CW \cdot (100-S)/S = 2 \times 11.5 = 23.0$ $absMP_{AFTIN} = (23.0+2.0)/102.0 = 0.245$.

On the other hand, the accuracy ranges of individual measuring instruments are approximately as follows.

Accuracy range of basis weight sensor: ±0.15 (g/m$^2$)

Accuracy range of moisture sensor: ±0.1 (%)

From these values, the accuracy levels of bone-dry basis weight and bone-dry coated weight can be calculated as shown below.

Accuracy of bone-dry basis weight= $\sqrt{0.1 \times 0.1 + 0.15 \times 0.15} = 0.18$ Accuracy of bone-dry coated weight $\Delta CW = \sqrt{0.18 \times 0.18 + 0.18 \times 0.18} = 0.25$.

From these calculations, errors in the size's coated weight per unit area and in the moisture percentage at the after-dryer 86 inlet are determined as shown below.

Accuracy of size's coated weight $$\Delta CW \cdot \frac{100-S}{S} = 0.25 \times 11.5 = 2.88$$

Accuracy of moisture percentage $\Delta absMP_{AFTIN}$ at after-dryer 86 inlet $$= \frac{\Delta CW \cdot \frac{100-S}{S}}{BD_{AFT}} = \frac{2.88}{102.0} = 0.028$$

This means that an error as large as $\Delta absMP_{AFTIN}/absMP_{AFTIN} = 0.028/0.245 = 11.4\%$ will occur depending on the accuracy of measuring instruments. The error in the bone-dry coated weight is comparatively large since the weight is calculated from measured values provided by four measuring instruments. This error increases further by a factor defined by the reciprocal of the size's concentration (approximately 10 times larger), if the amount of moisture contained in the size is included in the calculation. Consequently, such a large error as mentioned earlier occurs. This error results in yet another problem that precise control is not feasible.

As discussed heretofore, it is evident that precisely predicting the moisture percentage at a dryer inlet is of great significance in paper machine control.

It is therefore an object of the present invention to provide a method of paper machine control whereby the moisture percentage of a web at a dryer inlet is estimated, excellent control can be performed, and the time required for grade change can be reduced, as well as apparatus for the method.

BRIEF DESCRIPTION OF THE DRAWINGS

FIG. 2 is a table that summarizes parameters used in heat-transfer equations.

DETAILED DESCRIPTION OF THE PREFERRED EMBODIMENTS

Preferred embodiments of the present invention will now be described in detail with reference to the accompanying drawings.

Figure 1:
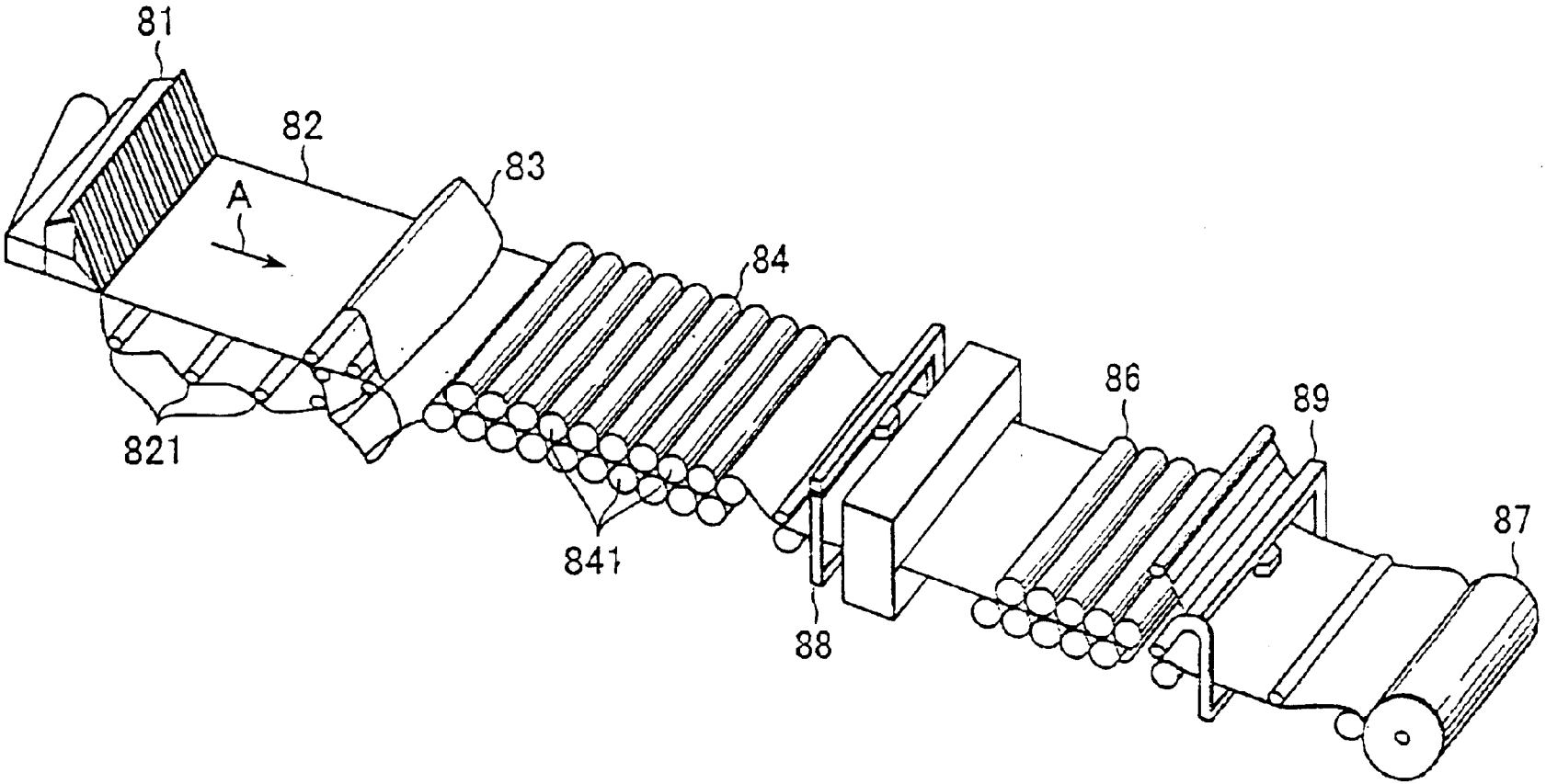
FIG.1 (PRIOR ART)
FIG. 1 is a schematic view showing the configuration of a typical paper machine.
Figure 3:
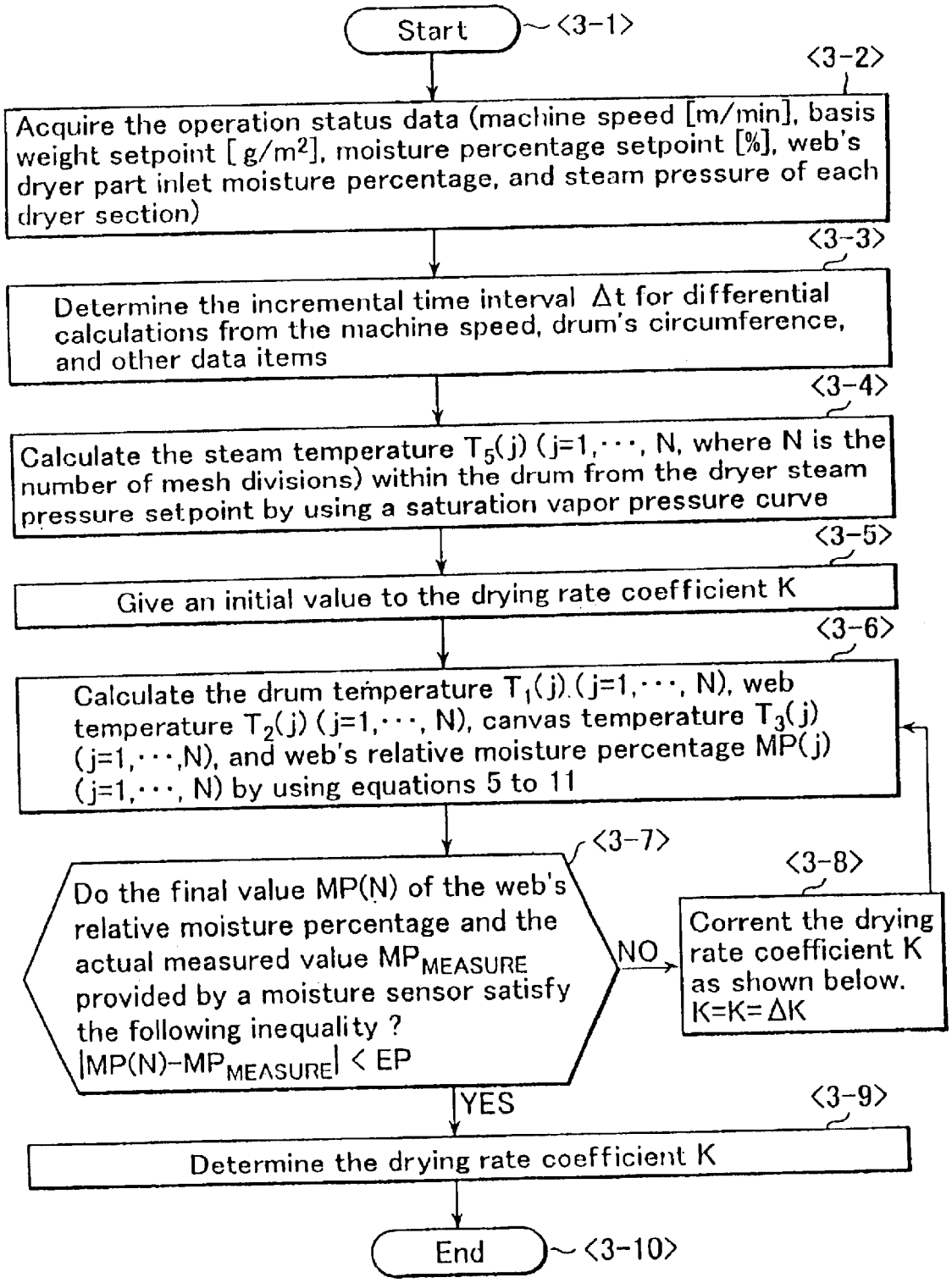
FIG.3 (PRIOR ART)
FIG. 3 is a flowchart representing steady-state simulation in a prior art method.
Figure 5:
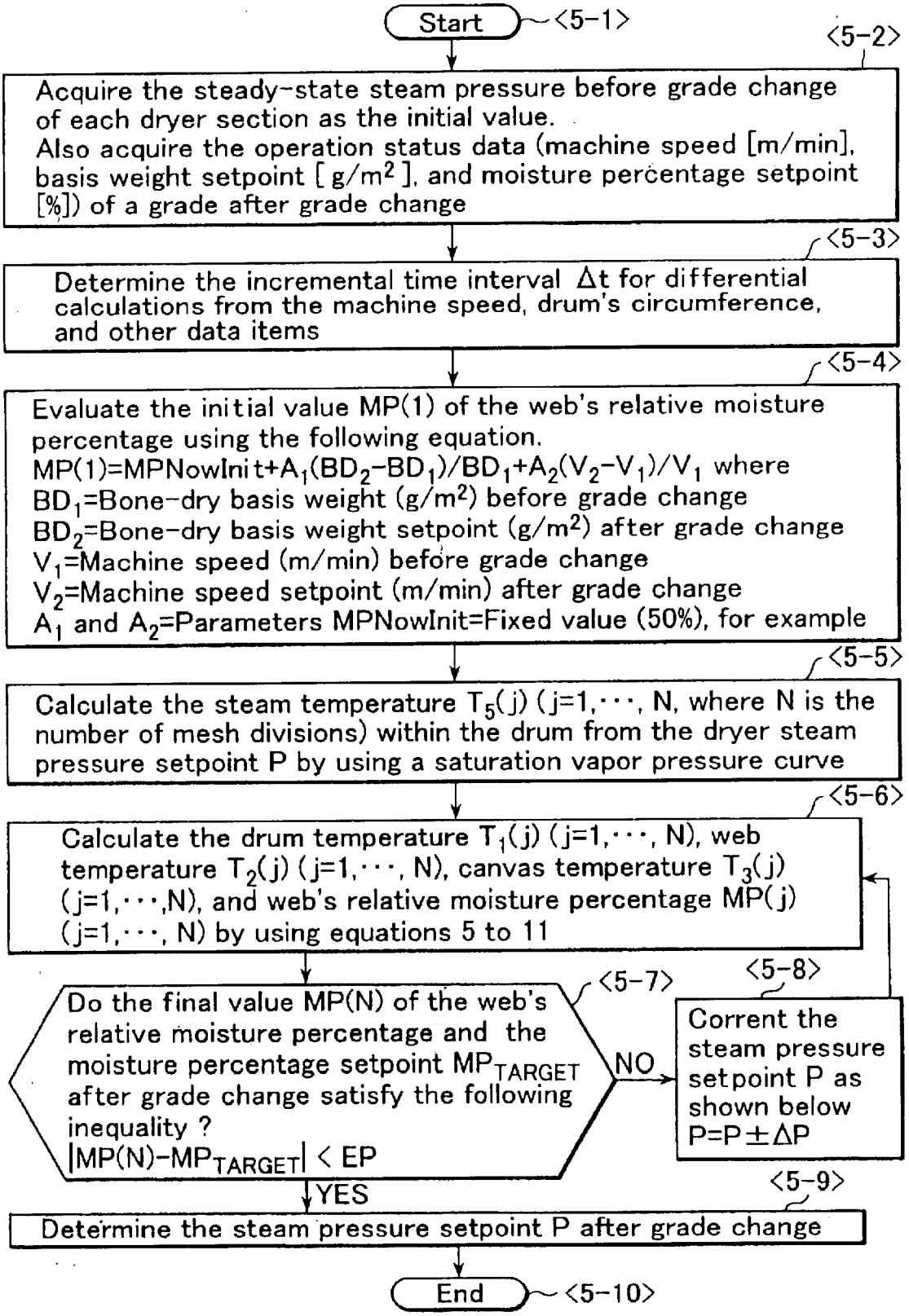
FIG. 5 is a flowchart representing one embodiment in accordance with the present invention.

A method of evaluating a steam pressure setpoint after grade change at a pre-dryer part is first explained by referring to FIGS. 3 and 5. In the first step, steady-state simulation is performed in the same way as for the prior art method shown in FIG. 3, in order to determine the drying rate coefficient K. In the second step, steam pressure after grade change is predicted. As discussed earlier, a value before grade change (e.g., 50%) is used as the moisture percentage MP(1) at a dryer part inlet in the prior art method of simulating the prediction of steam pressure after grade change. This method of prediction results in the problem that an error occurs in the predicted value of steam pressure. For this reason, equation 18 shown below is used to calculate the moisture percentage at the dryer part inlet (pre-dryer part inlet), which is the web's initial relative moisture percentage MP(1), when making numeric calculations for solving difference equations based on heat-transfer differential equations in the simulation of steam pressure prediction represented by the flowchart of FIG. 5.

$$MPNowInit + A_1 \cdot \frac{BD_2 - BD_1}{BD_1} + A_2 \cdot \frac{V_2 - V_1}{V_1} \tag{18}$$

where

MPNowInit=Initial moisture percentage (e.g., fixed to 50%) at dryer part inlet

MPNextInit=Initial moisture percentage at dryer part inlet for simulation of steam pressure prediction $BD_1$=Bone-dry basis weight (g/m$^2$) before grade change $BD_2$=Bone-dry basis weight setpoint (g/m$^2$) after grade change $V_1$=Machine speed (m/min) before grade change $V_2$=Machine speed (m/min) after grade change $A_1$=Ratio of change in dryer inlet moisture percentage to change in basis weight $A_2$=Ratio of change in dryer inlet moisture percentage to change in machine speed.

Figure 4:
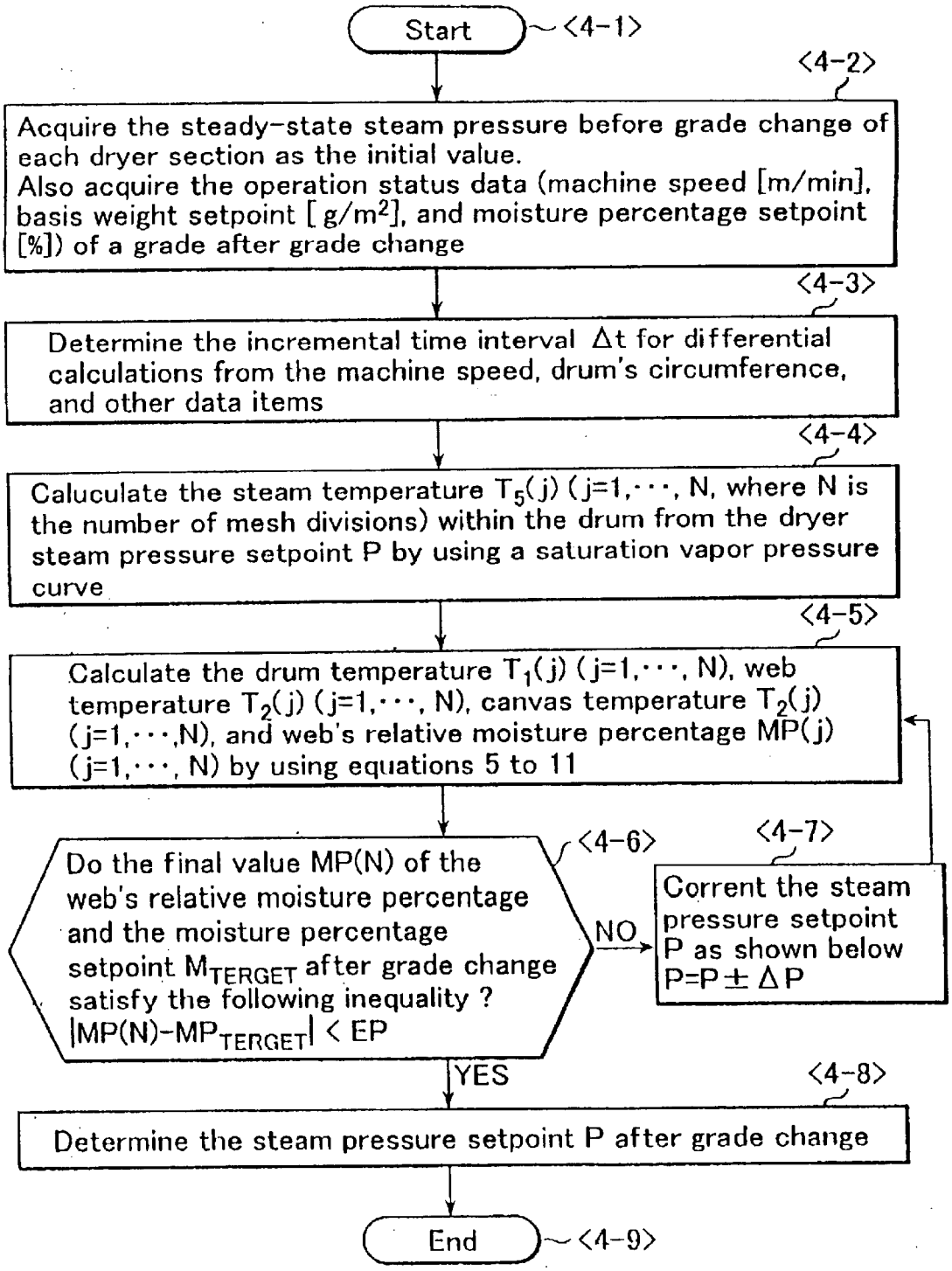
FIG.4 (PRIOR ART)
FIG. 4 is a flowchart representing the simulation of steam pressure prediction in the prior art method.

MPNowInit is also the initial value of the dryer part inlet moisture percentage used in the steady-state simulation shown in FIG. 3. The measured value of MPNowInit may be used if a moisture sensor is installed. It is also acceptable to use a fixed value or any other value appropriate for the condition of operation in the absence of the moisture sensor. For example, a value (e.g., 50%) input from the moisture sensor may be used. Note that $A_1$ and $A_2$ are tuning parameters and are adjusted according to the operation status. If we assume that $A_1=A_2=0$, the result of the simulation equals that of the prior art method of simulation shown in FIG. 4. Also note that MPNowInit can likewise be used as a tuning parameter.

Now, an example of calculation based on equation 18 is shown. If we define $A_1$ and $A_2$ as $A_1=8.7$ and $A_2=1.0$ and assume that $BD_1=100$ (g/m$^2$), $BD_2=125$ (g/m$^2$), $V_1=750$ (m/min), and $V_2=600$ (m/min), then equation 18 is calculated as $$MPNextInit=50+8.7\times25/100+1.0\times(-150)/750=52.0\%$$

This calculation example shows that there is a 2% difference from the case wherein the initial value of 50% before grade change is used as an initial value after grade change for steady-state simulation.

FIG. 5 is a flowchart representing the simulation of steam pressure prediction after grade change performed using equation 18.

In FIG. 5, operation status data, such as the machine speed, is read first. Then, an incremental time interval is determined from the machine speed, circumference of the drum, and other data items. These steps are the same as those of the prior art method of FIG. 4. Next, MPNextInit is calculated using equation 18 and the resulting value is substituted into the initial dryer inlet moisture percentage MP(1). In a further step, the drum temperature, web temperature, canvas temperature, and web's moisture percentage are calculated, in order to examine whether or not the web's final moisture percentage MP(N) has reached convergence. If convergence has not yet been reached, the steam pressure setpoint is corrected to once again calculate the drum temperature, and so on. This step is also the same as that of the prior art method of FIG. 4. The steam pressure setpoint thus corrected is used as the dryer steam pressure setpoint after grade change in order to control the paper machine.

Figure 7:
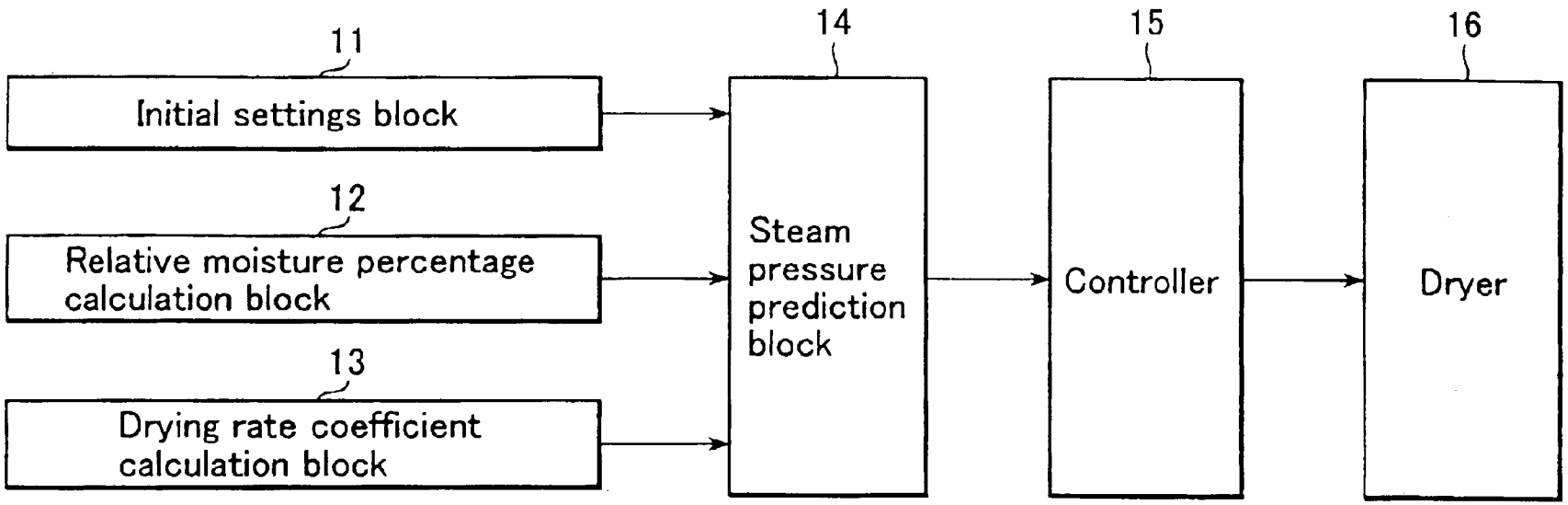
FIG. 7 is a block diagram showing the configuration of one embodiment in accordance with the present invention.

FIG. 7 is a block diagram showing the configuration of a paper machine control system whereby the method of paper machine control, including the method of steam pressure prediction shown in the flowchart of FIG. 5, is implemented. In FIG. 7, numeral 11 denotes an initial settings block for reading the current operation status or determining the incremental time interval Δt. Numeral 12 denotes a relative moisture percentage calculation block for calculating the initial value of a moisture percentage according to equation 18 discussed earlier. Numeral 13 denotes a drying rate coefficient calculation block for evaluating the drying rate coefficient by simulation according to the flowchart shown in FIG. 3.

Numeral 14 is a steam pressure prediction block, to which the outputs of the initial settings block 11, relative moisture percentage calculation block 12, and drying rate coefficient calculation block 13 are applied, in order to make a loop calculation in the algorithm flowchart of FIG. 5 and predict steam pressure after grade change. Numeral 15 is a controller for controlling the paper machine by using the steam pressure predicted by the steam pressure prediction block 14 as a dryer steam pressure setpoint after grade change. Numeral 16 is a dryer to be controlled. Thus, it is possible to realize a paper machine control system that enables the duration of grade change to be reduced.

Now, a method for evaluating a pressure setpoint at an after-dryer after grade change is explained. Firstly, steady-state simulation is explained by referring to FIG. 3. In the simulation, the absolute moisture percentage $absMP_{AFTIN}$ at an after-dryer inlet in a steady state is calculated using equation 12 discussed earlier. At this point, note that $absMP_{PREEND}$ is determined by the steady-state simulation of the pre-dryer. In addition, the bone-dry coated weight CW of a size is determined from equation 19 shown below.

$$\frac{1000 \times F \times (S/100) \times W}{V \times d} \tag{19}$$

where

CW=Size's bone-dry coated weight (g/m$^2$)

F=Moving average of size's flow rate (L/min)

S=Moving average of size's concentration (%)

W=Size's specific gravity (kg/L)

V=Machine speed (m/min)

d=Paper width (m).

The numerator of equation 19 is a product of the size's flow rate and concentration, thus representing the bone-dry weight of the size consumed in one minute. The numerator therefore has a unit of g/minute. The concentration S, which has a unit of %, is divided by 100 so that it is converted to a ratio. Likewise, the specific gravity W, which has a unit of kg/L, is multiplied by 1000 so that the unit is converted to grams.

The denominator of equation 19 is a product of the machine speed and paper width, thus representing the area of paper onto which the size is transferred in one minute. The denominator therefore has a unit of m$^2$/minute. Accordingly, by using this equation it is possible to determine the weight of the size transferred onto unit area of paper, i.e., the size's bone-dry coated weight CW.

The size's flow rate F and concentration S are measured with a flowmeter and concentration meter, respectively. Thus, the moving averages of these parameters are taken over a sufficiently long period of time such as five minutes since the parameters are not for use in quick-response, dynamic control. For this reason, it is possible to minimize the effect of short-period variations or errors in the measured values of the parameters even if there is any such variation or error.

From the absolute after-dryer inlet moisture percentage $absMP_{AFTIN}$, the web's initial moisture percentage MP(1) in the calculations for finding the numeric solutions of the difference equations in FIG. 3 is calculated according to equation 11. This calculation determines the drying rate coefficient K at the after-dryer part, as shown in FIG. 3. If a BM system is also installed before a size press, a convergence calculation is made separately for the pre-dryer and after-dryer. If not, a convergence calculation is made for the after-dryer only.

Figure 8:
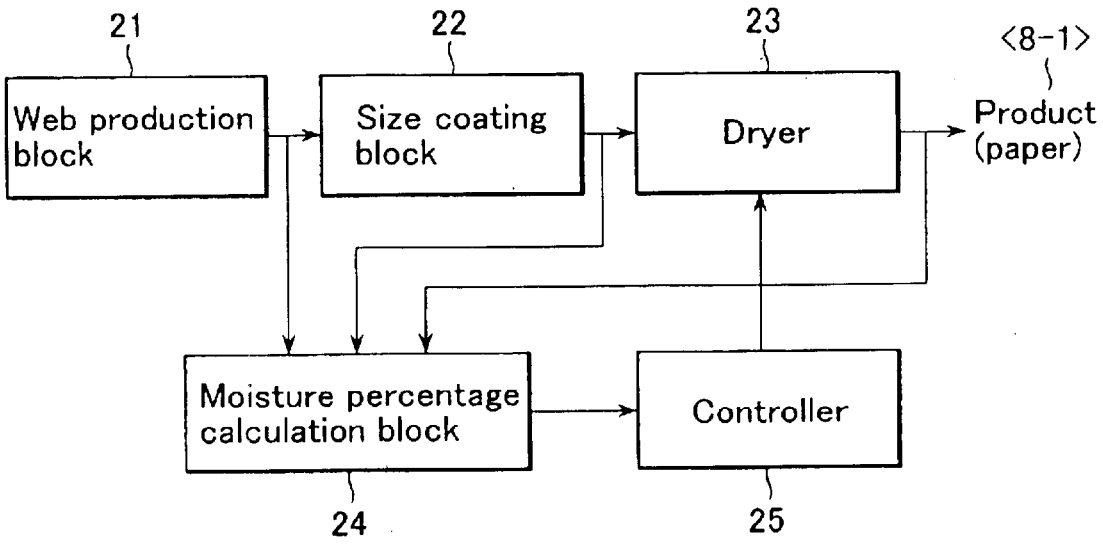
FIG. 8 is a block diagram showing the configuration of yet another embodiment in accordance with the present invention.

FIG. 8 is a block diagram showing the configuration of a paper machine control system that uses equation 19. In the figure, numeral 21 denotes a web production block for producing a web not yet subjected to size coating. Numeral 22 denotes a size coating block for coating the size onto the web produced at the web production block 21. Numeral 23 denotes a dryer for drying the web onto which the size has been coated. Numeral 24 denotes a moisture percentage calculation block for calculating the moisture percentage of the web coated with the size from equations 12 and 19 discussed earlier. Numeral 25 denotes a controller, to which the moisture percentage calculated and output by the moisture percentage calculation block 24 is input in order to control the dryer 23 according to the moisture percentage.

Figure 6:
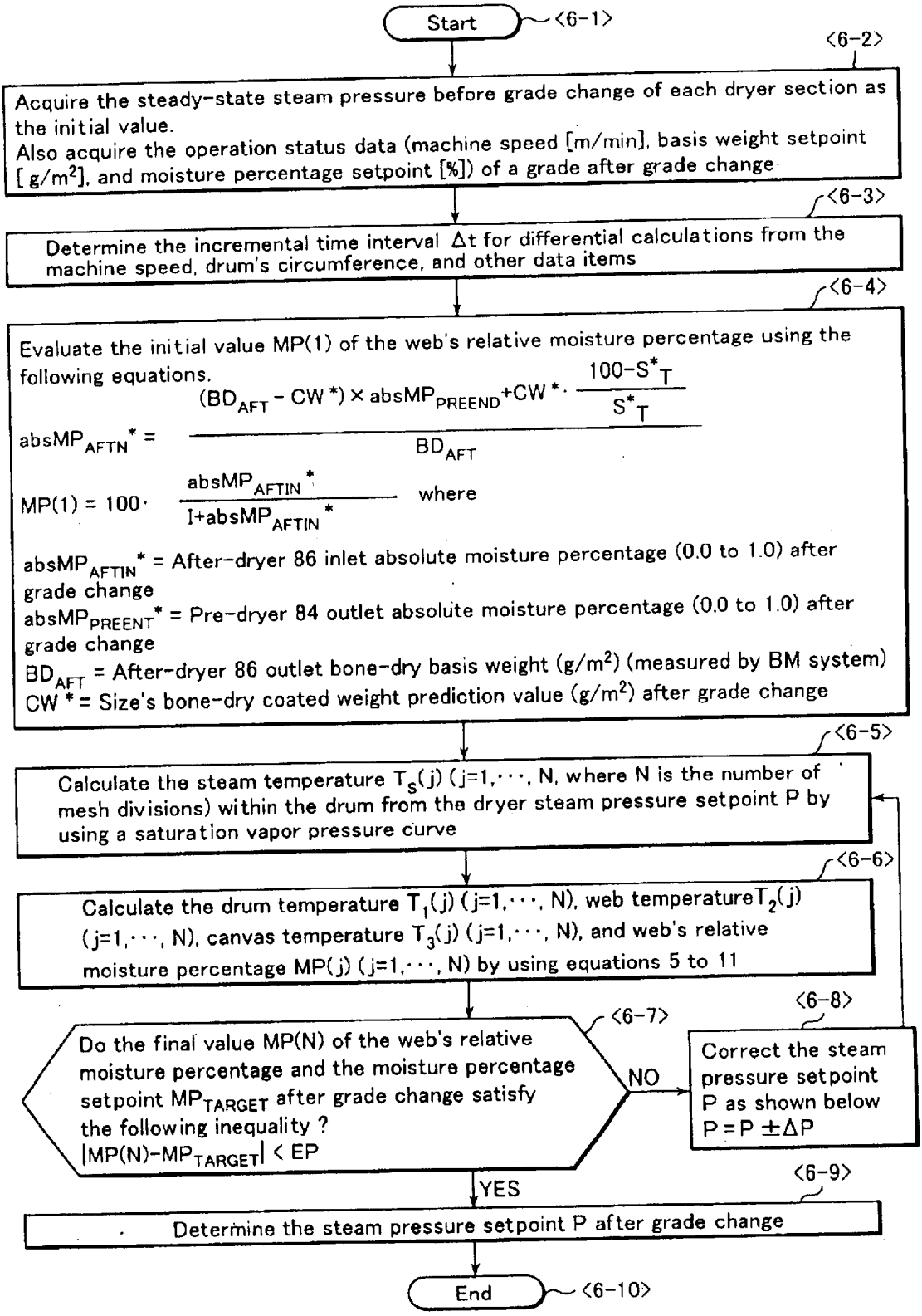
FIG. 6 is a flowchart representing another embodiment in accordance with the present invention.

Now, the simulation of after-dryer steam pressure prediction during grade change shown in FIG. 6 is discussed. Under normal conditions, the machine speed changes during grade change. Since the amount of size transferred at the size press is proportional to the machine speed, the size's flow rate also changes in proportion to the machine speed if the machine speed changes. Consequently, equation 20 shown below holds true.

$$\frac{F^*}{F} = \frac{V^*}{V} \tag{20}$$

where

F=Moving average of size's flow rate (L/min) at machine speed V

F*=Moving average of size's flow rate (L/min) at machine speed V*

V, V*=Machine speed (m/min).

If the machine speed changes from V to V* and the size's concentration from S to S* through the grade change, then the size's bone-dry coated weights CW and CW* before and after the grade change can be calculated according to equation 21 below.

$$\begin{aligned} CW^* &= \frac{1000 \times F^* \times (S^*/100) \times W}{V^* \times d} \\ &= \frac{1000 \times F \times (S/100) \times W}{V \times d} \cdot \frac{S^*}{S} \\ &= CW \cdot \frac{S^*}{S} \end{aligned} \tag{21}$$

where

CW and CW*=Bone-dry coated weights (g/m$^2$) before and after grade change, respectively F and F*=Moving averages of size's flow rates (L/min) before and after grade change, respectively S and S*=Moving averages of size's concentrations (%) before and after grade change, respectively W =Size's specific gravity (kg/L)

d=Paper width (m)

According to equation 21, it is possible to predict the bone-dry coated weight after grade change using equation 22 below if concentration setpoints of the size are given for each grade.

$$CW \cdot \frac{S_T^*}{S_T} \tag{22}$$

where

CW=Bone-dry coated weight (g/m$^2$) before grade change based on equation 19

CW*=Predicted bone-dry coated weight (g/m$^2$) after grade change $S_T$ and $S^*_T$=Size's concentration setpoints (%) before and after grade change, respectively.

This means that it is possible to know the bone-dry coated weight after grade change before a grade change takes place.

As explained earlier, the absolute pre-dryer outlet moisture percentage $absMP_{PREEND}^*$ after grade change can be evaluated by simulation. In addition, the pre-dryer outlet bone-dry basis weight is given by subtracting the size's bone-dry coated weight from the after-dryer outlet bone-dry basis weight. Consequently, it is possible to predict the absolute after-dryer inlet moisture percentage $absMP_{AFTIN}^*$ after grade change before a grade change takes place, according to equation 23 below.

$$absMP^*_{AFTIN} = \frac{(BD_{AFT} - CW^*) \times absMP^*_{PREEND} + CW^* \cdot \frac{100 - S^*_T}{S^*_T}}{BD_{AFT}} \quad (23)$$

where $absMP_{AFTIN}^*$=Absolute moisture percentage (0.0 to 1.0) after grade change at after-dryer 86 inlet $absMP_{PREEND}^*$=Absolute moisture percentage (0.0 to 1.0) after grade change at pre-dryer 84 outlet $BD_{AFT}$=Bone-dry basis weight (g/m$^2$) at after-dryer 86 outlet (measured with BM system)

CW*=Predicted bone-dry coated weight (g/m$^2$) after grade change $S^*_T$=Size's (coating agent's) concentration setpoint (%) after grade change.

By referring to FIG. 6, a method for calculating the predicted value of after-dryer steam pressure after grade change using the absolute after-dryer moisture percentage $absMP_{AFTIN}^*$ after grade change is explained. In FIG. 6, the steady-state steam pressure setpoint of each section of the dryer before grade change, and operation status data after grade change, such as the machine speed, are read first. Then, an incremental time interval is determined from the machine speed, circumference of the drum, and other data items. These steps are the same as those of the prior art method of FIG. 4. In a further step, $absMP_{AFTIN}^*$ is calculated using equation 23, and the resulting value is substituted into the initial dryer inlet moisture percentage MP(1). In yet a further step, the drum temperature, web temperature, canvas temperature, and web's relative moisture percentage are calculated, in order to examine whether or not the web's final moisture percentage MP(N) has reached convergence. If convergence has not yet been reached, the steam pressure setpoint is corrected to once again calculate the drum temperature, and so on. This step is also the same as that of the prior art method of FIG. 4. The steam pressure setpoint thus corrected is used as the dryer steam pressure setpoint after grade change in order to control the paper machine.

A method of switching from the steam pressure setpoint before grade change to the above-mentioned steam pressure setpoint after grade change may be in compliance with the method described in the specification of U.S. Pat. No. 3,094,798 filed earlier. Other alternative methods may also be permissible.

Figure 9:
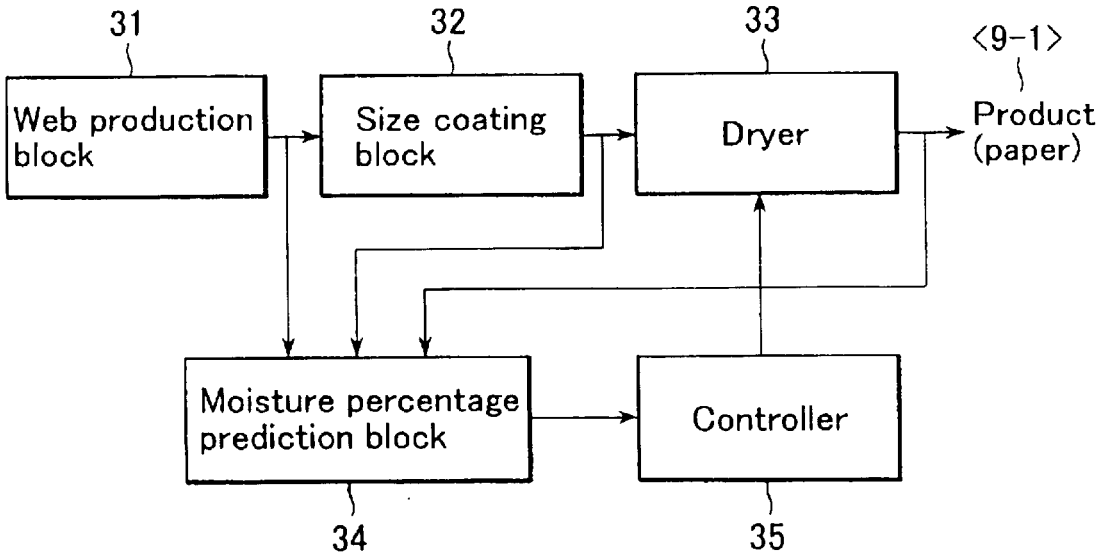
FIG. 9 is a block diagram showing the configuration of yet another embodiment in accordance with the present invention.

FIG. 9 is a block diagram showing the configuration of a system for paper machine control at the time of grade change. In the figure, numeral 31 denotes a web production block for producing a web not yet subjected to size coating. Numeral 32 denotes a size coating block for coating the size onto the web produced at the web production block 31. Numeral 33 denotes a dryer for drying the web onto which the size has been coated. Numeral 34 denotes a moisture percentage prediction block for predicting the moisture percentage of the web after grade change from equations 12 and 22 discussed earlier. Numeral 35 denotes a controller, to which the output of the moisture percentage prediction block 34 is applied in order to control the dryer 33. The controller 35 controls the dryer 33 according to the output of the moisture percentage prediction block 34 after the grade change takes place.

Figure 10:
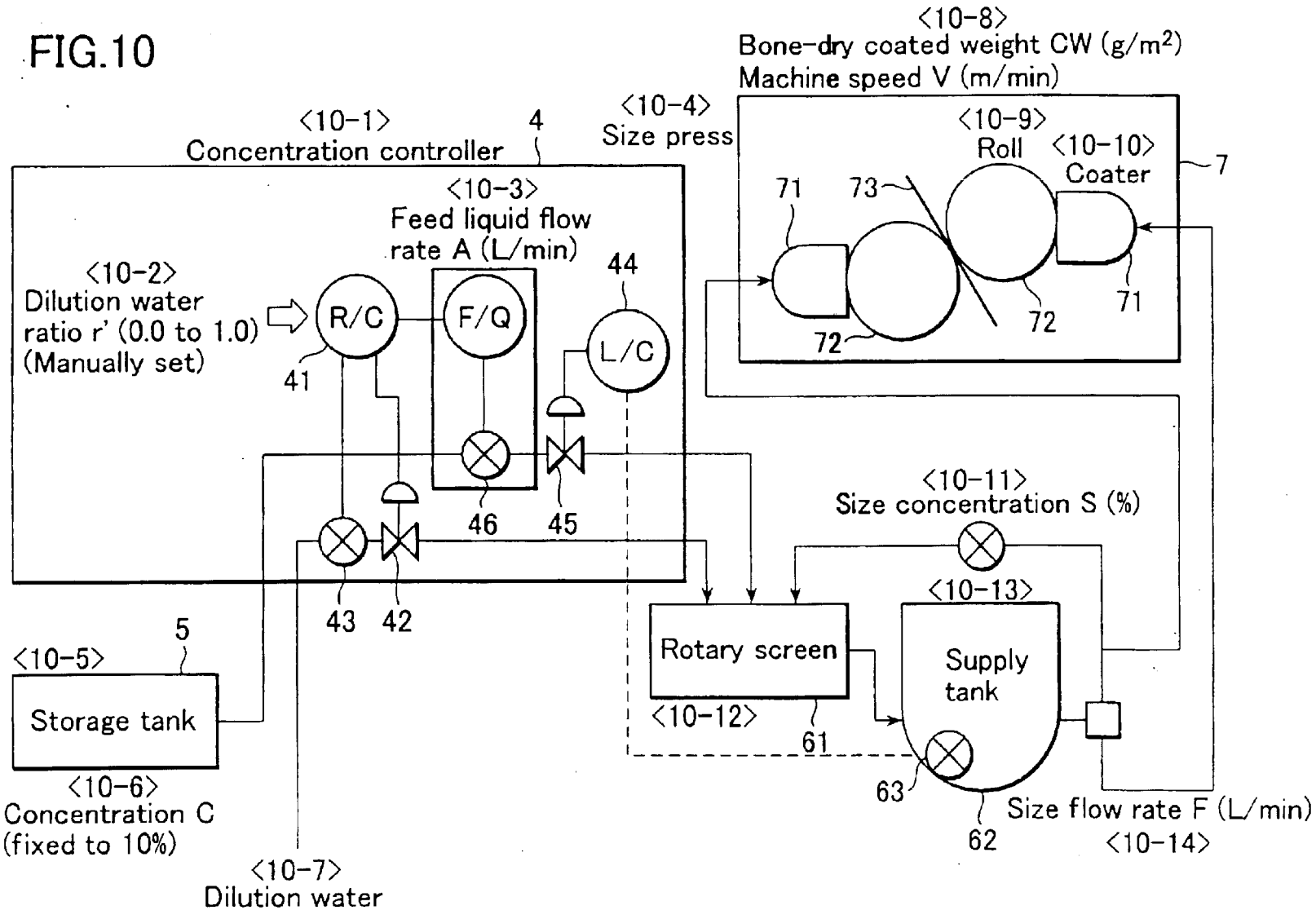
FIG. 10 is a diagrammatic view showing the configuration of yet another embodiment in accordance with the present invention.

FIG. 10 is a diagrammatic view showing the configuration of a system for controlling size coating. In the figure, numeral 4 denotes a concentration controller, wherein a size with a constant concentration stored in a storage tank 5 is mixed with dilution water to produce a size with a desired concentration. The flow rate of a size with a constant concentration of C (=10%) is detected by a flowmeter 46 and input to a ratio setting unit 41. Also, the ratio of dilution water is input to the ratio setting unit 41 manually for each grade. The ratio setting unit 41 controls a valve 42 so that a preset ratio of dilution water is reached. The size with the constant concentration is mixed with dilution water at a rotary screen 61 and stored in a supply tank 62.

The size stored in the supply tank 62 is injected into a coater 71 within a size press 7, transferred to a roll 72, and then transferred further to a web (paper) 73 which is a product. The level of the supply tank 62 is measured with a level meter 63 and the measured value is input to a valve controller 44. The valve controller 44 controls a valve 45 so that the level of the supply tank 62 is kept constant.

Since the rate of transfer at the coater 71 is constant, the flow rate of the size changes in proportion to the machine speed.

If we assume the flow rate of the size supplied from the storage tank 5 is A (L/min) and the ratio set in the ratio setting unit 41 is r, then the flow rate F (L/min) of the size supplied to the coater 71 is $$F=(1+r):A$$

In addition, the following relationship exists between the size's concentration S and the dilution water's ratio r.

$$S = \frac{C \times A}{(1+r) \times A} = \frac{C}{1+r}$$

Consequently, it is possible to calculate the bone-dry coated weight CW from equation 19 and evaluate a bone-dry coated weight after grade change from equation 22. According to the results of the calculation and evaluation and the result of calculating a pre-dryer outlet moisture percentage based on the simulation of the condition of drying by the pre-dryer, it is also possible to calculate the after-dryer inlet moisture percentage before grade change from equation 12 discussed earlier. Furthermore, it is possible to evaluate a moisture percentage after grade change by substituting the $CW^*_T$ of equation 22 for the CW of equation 12.

As is evident from the description heretofore given, the following advantages can be expected according to the present invention.

In one aspect of the paper machine control method according to the present invention, wherein a dryer steam pressure after grade change is predicted by solving difference equations obtained by differentiating heat-transfer equations that hold true among a steam drum, web and canvas and the predicted value is used as a dryer steam pressure setpoint after grade change, the initial value of a relative moisture percentage at a dryer part (pre-dryer part) inlet is calculated according to a given equation when solving the difference equations.

Accordingly, it is possible to obtain a value closer to an actual steam pressure setpoint as the predicted value of a dryer steam pressure after grade change. Consequently, it is possible to reduce the duration of grade change by adopting the predicted value as the steam pressure setpoint after grade change; reduce the amount of broke; and improve productivity.

Another advantage is that since such items of data concerning the drying condition within the dryer as the web temperature and moisture percentage can be predicted with higher precision, it is possible to provide an operator with more useful information for operations.

In another aspect of the present invention, the parameters $A_1$, $A_2$ and MPNowInit are tuned according to the operation status. Consequently, the versatility of the paper machine control method increases, since the method can deal with a variety of paper machines and operation statuses. The versatility can further be increased by tuning the parameters.

In yet another aspect of the present invention, the bone-dry coated weight of a size is calculated according to a given equation; the moisture percentage of a web at an after-dryer part is predicted from the bone-dry coated weight; and the dryer is controlled using the predicted moisture percentage.

Consequently, it is possible to precisely calculate the coated weight even if no BM system is installed before the size press. This means that the dryer can be controlled easily by measuring only the moisture percentage at the after-dryer part outlet and making a convergence calculation. It is also possible to control the dryer with higher precision since a precise coated weight can be evaluated without being affected by instrument errors, thereby improving product quality.

Yet another advantage is that the control method can be used for operation monitoring or steady-state control if there are no BM systems installed.

Yet another advantage is that an apparatus for the control method can be built more easily and economically if the number of BM systems can be reduced.

Yet another advantage is that it is possible to precisely estimate the moisture percentage after grade change, thus reducing the duration of grade change and the amount of broke and improving productivity.

In yet another aspect of the present invention, the moving averages of measured values are used as the flow rate and concentration of a size. Consequently, it is possible to prevent the effect of short-period variations or errors in flowmeters and concentration meters, whereby the moisture percentage can be estimated with higher precision. Furthermore, it is possible to use inexpensive flowmeters and concentration meters.

What is claimed is:

1. A method for controlling a paper machine, comprising the steps of:

solving difference equations obtained by differentiating heat transfer equations that hold true among a steam drum, web and canvas;

predicting a dryer steam pressure after grade change; and using said predicted dryer steam pressure as a dryer steam pressure setpoint after grade change; wherein the initial value of a web's moisture percentage at a dryer part inlet is calculated according to changes in a bone dry coated weight and machine speed when solving said difference equations; and wherein the initial value of said web's dryer part inlet moisture percentage after grade change is evaluated according to the following equation;

$$\text{initial value of web's moisture percentage} = MPNowInit + A_1 \cdot \frac{BD_2 - BD_1}{BD_1} + A_2 \cdot \frac{V_2 - V_1}{V_1}$$

where $BD_1$=bone dry weight before grade change $BD_2$=bone dry weight setpoint after grade change $V_1$=machine speed before grade change $V_2$=machine speed setpoint after grade change; and $A_1$, $A_2$, and MPNOWInit=parameters.

2. The method of claim 1, wherein said parameters $A_1$, $A_2$ and MPNowInit are tuned according to the status of operation.

3. A system for controlling a paper machine, comprising:

an initial settings block for acquiring current operation status data and determining an incremental time interval for differential calculations from such data items as machine speed and the circumference of a steam drum;

a moisture percentage calculation block;

a drying rate coefficient calculation block for evaluating a drying rate coefficient by simulation;

a steam pressure prediction block, to which the outputs of said initial settings block, said moisture percentage calculation block and said drying rate coefficient calculation block are applied in order to solve difference equations obtained by differentiating heat transfer equations that hold true among a steam drum, web and canvas, and thereby predict a dryer steam pressure after grade change; and a controller to which the output of said steam pressure prediction block is applied; wherein said moisture percentage calculation block calculates the initial value of a dryer part inlet moisture percentage used when said steam pressure prediction block solves said difference equations according to changes in one dry coated weight and machine speed, and said controller controls a paper machine using said predicted steam pressure output by said steam pressure prediction block as a steam pressure setpoint after grade change; and wherein the initial value of said web's dryer part inlet moisture percentage after grade change is evaluated according to the following equation:

$$\text{initial value of web's moisture percentage} = MPNowInit + A_1 \cdot \frac{BD_2 - BD_1}{BD_1} + A_2 \cdot \frac{V_2 - V_1}{V_1}$$

where $BD_1$=bone dry weight before grade change $BD_2$=bone dry weight setpoint after grade change $V_1$=machine speed before grade change $V_2$=machine speed setpoint after grade change; and $A_1$, $A_2$ and MPNowInit=parameters.

4. The system of claim 3, wherein said parameters $A_1$, $A_2$ and MPNowInit are tuned according to the status of operation.

5. A method for controlling a paper machine wherein raw pulp is discharged onto a wire part, moisture contained in said raw pulp is removed by said wire part and by other means to form a web, said web is dried by a pre-dryer part and a size is applied to said web, and then said web is further dried by an after dryer part so that a product is produced, comprising the steps of:

calculating the bone dry coated weight of a size from the size's flow rate, size's concentration, size's specific gravity, machine speed, and web width;

evaluating said web's moisture percentage at an after dryer part inlet after a size press from said bone dry coated weight; and controlling said pre-dryer and after dryer parts using said evaluated moisture percentage; and wherein said bone dry coated weight of a size is calculated according to the following equation:

$$\text{size's coated weight}=CW=A(F\times S\times W)/(V\times d)$$

where

F=size's flow rate

S=size's concentration;

W=size's specific gravity

V=machine speed d=web width; and

A=constant;

said web's moisture percentage at an after dryer part inlet after a size's press is evaluated from said bone dry coated weight; and said after dryer is controlled using said evaluated moisture percentage.

6. The method of claim 5, wherein an absolute moisture percentage at said after dryer part inlet after said size press is evaluated according to the following equation:

$$\text{web's absolute moisture percentage at after dryer part inlet}=[absM_0+CW(100-S)/S]/BD_{AFT}$$

$absM_0$=amount of moisture per unit area of web before size coating (calculation by simulation)

$BD_{AFT}$=bone dry weight at pre-dryer part outlet

CW=size's bone dry coated weight; and

S=size's concentration (%).

7. The system of claim 5, wherein the moving averages of measured values are used as the flow rate and concentration of said size.

8. A system for controlling a paper machine, comprising:

a web production block for producing a web not yet subjected to size coating;

a pre-dryer part for drying said web produced by said web production block;

a size coating block for coating a size onto said web;

an after dryer part for drying said size coated web;

a moisture percentage of said size coated web; and a controller, to which the output of said moisture percentage calculation block is applied in order to control said pre-dryer and after dryer parts; wherein said moisture percentage calculation block calculates the bone dry coated weight of said size according to equation 1 below, as well as the absolute after dryer part inlet moisture percentage of said size coated web according to equation 2 below:

$$\text{size's bone-dry coated weight}=CW=A\cdot\frac{F\times S\times W}{V\times d} \quad (1)$$

$$\text{web's absolute moisture percentage at after-dryer part inlet}=\frac{absM_0+CW\cdot\frac{100-S}{S}}{BD_{AFT}} \quad (2)$$

where

CW=size's bone dry coated, weight

F=size's flow rate

S=size's concentration (%)

W=size's specific gravity

V=machine speed d=web width

A=constant $AbsM_0$=amount of moisture per unit of area of web before size coating (calculation by similation); and $BD_{AFT}$=bone dry weight at pre-dryer part outlet.

9. The system of claim 8, wherein said moisture percentage prediction block calculates the bone dry coated weight of said size after grade change according to equation 1 below, as well as the after dryer part inlet moisture percentage of said size coated web after grade change according to equation 2 below:

$$CW^*=CW\cdot\frac{S_t^*}{S_t} \quad (1)$$

$$\text{absolute after dryer part inlet moisture percentage}=\frac{absM_0+CW^*\cdot\frac{100-S_t^*}{S_t^*}}{BD_{AFT}} \quad (2)$$

where

CW=bone dry coated weight of size before grade change

CW*=predicted bone dry coated weight of size after grade change $S_t$=size's concentration before grade change $S^*_t$=size's concentration setpoint after grade change $absM_0$=amount of moisture per unit area of web before size coating (calculation by simulation); and $BD_{AFT}$=bone dry weight at pre-dryer part outlet.

10. The system of claim 8, wherein the moving average of measured values are used as the flow rate and concentration of said size.

11. A method for controlling a paper machine wherein raw pulp is discharged onto a wire part, moisture contained in said raw pulp is removed by said wire part and by other means to form a web, said web is dried by a pre-dryer and a size is applied to said web, and then said web is further dried by an after dryer so that a product is produced, comprising the steps of:

calculating the predicted bone dry coated weight of a size after grade change according to said size's bone dry coated weight before grade change, said size's concentration before grade change, and said size's concentration setpoint after grade change; and determining said web's moisture percentage after grade change at an after dryer part inlet from said predicted bone dry coated weight; wherein said predicted bone dry coated weight of a size after grade change is evaluated according to the following equation;

$$\text{predicted bone dry coated weight of a size after grade change}=CW^*=CW\cdot\frac{S_T^*}{S_T}$$

where

CW*=predicted bone dry coated weight of size before grade change

CW=bone dry coated weight after grade change of size $S_t$=size's concentration before grade change; and $S^*_t$=size's concentration setpoint after grade change.

12. The method of claim 11, wherein a dryer inlet moisture percentage after grade change is evaluated according to the following equation:

$$\text{absolute dryer inlet moisture percentage}=[absM_0+CW^*(100-S^*_t)/S^*_t]/BD_{AFT}$$

where $absM_0$=amount of moisture per unit area of web before size coating (calculation by simulation)

CW*=size's predicted bone dry coated weight after grade change $BD_{AFT}$=bone dry basis weight set point at dryer outlet; and $S^*_t$=size's concentration setpoint after grade change.

13. A method of controlling a paper machine, comprising the steps of:

solving difference equations obtained by differentiating heat transfer equations that hold true among a steam drum, web and canvas;

predicting a dryer steam pressure after grade change; and using said predicted dryer steam pressure as a dryer steam pressure setpoint after grade change; wherein the initial value of a web's moisture percentage at a dryer part inlet is calculated according to changes in a bone dry coated weight before grade change and setpoint after grade change, and changes in machine speed before grade change and setpoint after grade change when solving said difference equations.

14. A system for controlling a paper machine, comprising:

an initial settings block for acquiring current operation status data and determining an incremental time interval for differential calculations from such data items as machine speed and the circumference of a steam drum;

a moisture percentage calculation block;

a drying rate coefficient calculation block for evaluating a drying rate coefficient by simulation;

a steam pressure predicting block, to which the outputs of said initial settings block, said moisture percentage calculation block and said drying rate coefficient calculation block are applied in order to solve difference equations obtained by differentiating heat transfer equations that hold true among a steam drum, web and canvas, and thereby predict a dryer steam pressure after grade change; and a controller to which the output of said steam pressure prediction block is applied; wherein said moisture percentage calculation block calculates the initial value of a dryer part inlet moisture percentage used when said steam pressure prediction block solves said difference equations according to changes in a bone dry coated weight before grade change and setpoint after grade change and changes in machine speed before grade change and set point after grade change, and said controller controls a paper machine using said predicted steam pressure output by said steam pressure prediction block as a steam pressure set point after grade change.

15. A method for controlling a paper machine wherein raw pulp is discharged onto a wire part, moisture contained in said raw pulp is removed by said wire part and by other means to form a web, said web is dried by a pre-dryer part and a size is applied to said web, and then said web is further dried by an after dryer part so that a product is produced, comprising the steps of:

calculating the bone dry coated weight of a size before and after change of grade from the size's flow rate, size's concentration, size's specific gravity, machine speed before and after grade change, and web width:

evaluating said, web's moisture percentage at an after dryer part inlet after a size press from said bone dry coated weight; and controlling said pre-dryer and after dryer parts using said evaluated moisture percentage.

16. The method of claim 15, wherein said calculating step comprises calculating the predicted bone dry coated weight of a size after grade change according to said size's bone dry coated weight before grade change, said size's concentration before grade change, and said size's concentration setpoint after grade change; and wherein said evaluating step comprises determining said web's moisture percentage after grade change at an after dryer part inlet from said predicted bone dry coated weight.

17. A method of controlling a paper machine wherein a web is wound around steam drums of a steam dryer along with canvas so that said web is dried, and the steam pressure after grade change applied to each steam drum is predicted and controlled in order to change the moisture percentage of said web toward a given setpoint during grade change, comprising the steps of:

adapting thermal equilibrium equations between said steam drum and said canvas, between said steam drum and said web, and between said canvas and said web, and rewriting said thermal equilibrium equations into difference equations;

acquiring before grade change at least the steam pressure of said steam dryer, basis weight of said web, machine speed, and dryer part outlet moisture percentage of said web, by using sensors;

applying an initial after dryer part inlet moisture percentage of said web, as well as other initial values, to said difference equations;

solving said difference equations repeatedly at a given time interval corresponding to a difference travelled by said web;

determining the drying rate coefficient of said web and a pattern of said web's steady state moisture percentage transition along the direction in which said web moves within said dryer part, by repeating said solution step until a calculated final moisture percentage agrees with an actual measured value acquired with a sensor to within a given tolerance range;

acquiring at least the preset basis weight of said web, present machine speed, and preset dryer part outlet moisture percentage of said web as operating process variable after grade change when making a grade change;

applying a value to said difference equation as the initial dryer part inlet moisture percentage of said web;

varying said steam pressure applied to each of said steam drums, in order to make said calculated final moisture percentage agree with said initial dryer part outlet moisture percentage to within a given tolerance range;

solving said difference equations repeatedly at a given time interval corresponding to a distance traveled by said web;

determining a pattern of said steam pressure applied to each of said steam drums along the direction in which said web moves; and varying said steam pressure applied to each of said steam drums, so that the variation of said steam pressure agrees with said steam pressure pattern when an actual grade change is made.

18. A system of controlling a paper machine wherein a web is wound around steam drums of a steam dryer along with canvas so that said web is dried, and a steam pressure after grade change is applied to each steam drum is predicted and controlled in order to change the moisture percentage of said web toward a given setpoint during grade change, comprising:

storage means for adopting thermal equilibrium equations between said steam drum and said canvas, between said stream drum and said web, and between said canvas and said web, and storing said thermal equilibrium as different equations;

detection means for acquiring before grade change at least the steam pressure of said steam dryer, basis weight of said web, machine speed, and dryer part outlet moisture percentage of said web;

calculating means for applying an initial after dryer part moisture percentage of said web, as well as other initial values, to said difference equations, solving said difference equations repeatedly at a given time interval corresponding to a distance traveled by said web, and determining the drying rate coefficient of said web and a pattern of said web's steady state moisture percentage transition along the direction in which said web moves within said dryer part, by repeating said solution step until a calculated final moisture percentage agrees with an actual measured value acquired with a sensor to within a given tolerance range;

setting means for acquiring after grade change and setting at least the preset basis weight of said web, present machine speed, and preset dryer part inlet moisture percentage of said web as operating process variables after grade change when making a grade change;

input means for applying a value to said difference equations as the initial dryer part inlet moisture percentage of said web;

another calculation means for varying said steam pressure applied to each of said steam drums, in order to make said calculated final moisture percentage agree with said initial dryer part outlet moisture percentage to within a given tolerance range, solving said difference equations repeatedly at a given time interval corresponding to a distance traveled by said web, and determining a pattern of said steam pressure applied to each of said steam drums along the direction which said web moves; and variation means for varying said steam pressure applied to each of said steam drums, so that the variation of said steam pressure agrees with said steam pressure pattern when an actual grade change is made.

* * * * *